US008242976B2

(12) United States Patent
Matsunami et al.

(10) Patent No.: US 8,242,976 B2
(45) Date of Patent: Aug. 14, 2012

(54) DISPLAY DRIVING DEVICE, WHICH PERFORMS SCAN DRIVING OF A DISPLAY PANEL

(75) Inventors: Kazuhiro Matsunami, Nagano (JP); Hideto Kobayashi, Nagano (JP); Makoto Tanaka, Nagano (JP)

(73) Assignees: Fuji Electric Systems Co., Ltd., Tokyo (JP); L.G. Electronics, Inc., Seoul (KR)

( * ) Notice: Subject to any disclaimer, the term of this patent is extended or adjusted under 35 U.S.C. 154(b) by 1008 days.

(21) Appl. No.: 11/984,372

(22) Filed: Nov. 16, 2007

(65) Prior Publication Data

US 2008/0211740 A1 Sep. 4, 2008

(30) Foreign Application Priority Data

Nov. 20, 2006 (JP) ..... 2006-312409

(51) Int. Cl.
*G09G 3/28* (2006.01)

(52) U.S. Cl. ..... 345/60

(58) Field of Classification Search ..... 345/60, 345/61, 100

See application file for complete search history.

(56) References Cited

U.S. PATENT DOCUMENTS

| | | | | |
|---|---|---|---|---|
| 5,739,641 | A * | 4/1998 | Nakamura et al. | 315/169.1 |
| 2007/0035481 | A1 * | 2/2007 | Kim | 345/68 |
| 2007/0273412 | A1 | 11/2007 | Yoshida et al. | |

FOREIGN PATENT DOCUMENTS

| | | | |
|---|---|---|---|
| JP | 61-263027 A | | 11/1986 |
| JP | 61263027 A | * | 11/1986 |
| JP | 10-336006 A | | 12/1998 |
| JP | 2005-129121 | | 5/2005 |
| JP | 2005-129121 A | | 5/2005 |
| JP | 2005129121 A | * | 5/2005 |
| JP | 2008-003567 A | | 1/2008 |

* cited by examiner

*Primary Examiner* — Chanh Nguyen
*Assistant Examiner* — John Kirkpatrick
(74) *Attorney, Agent, or Firm* — Rabin & Berdo, P.C.

(57) ABSTRACT

In a display driving device which performs scan driving of a PDP or similar, to enable rapid scan operation, reduction of the chip size, and lowering of costs, as well as elimination of coupling problems. The display driving device is provided with a pull-up switching element Nu connected to a first driving voltage (VDH) supply line and common to all bits; diodes D1 to DN for each bit, connected between the pull-up switching element Nu and driving voltage output terminals for each bit; pull-down switching elements Nd1 to NdN for each bit, connected between a second driving voltage (GND) supply line and the driving voltage output terminals for each bit; and resistance elements R1 to RN for each bit, connected between the first driving voltage supply line and the pull-down switching elements Nd1 to NdN.

8 Claims, 12 Drawing Sheets

DISPLAY DRIVING DEVICE, WHICH PERFORMS SCAN DRIVING OF A DISPLAY PANEL

BACKGROUND OF THE INVENTION

1. Field of the Invention

This invention relates to a display driving device which performs scan driving of a plasma display panel (hereafter "PDP") or other display panel, and in particular relates to a display driving device incorporated into an integrated circuit.

2. Description of the Background

A PDP uses light emission at the intersections of a matrix of electrodes accompanying a rare gas plasma discharge, causing light emission at the intersections of row electrodes and column electrodes selected by a scan driver and a data driver respectively. FIG. 7 is a block diagram showing the configuration of a scan driver IC of the prior art in such a PDP.

A scan driver IC comprises numerous unit circuits (output circuits); the unit circuits, or their output, are called bits. Scan data (DATA) input from the data terminal of a scan driver IC is transferred, in the direction of the arrow in the figure, to shift registers SR1 to SRN (where N is an integer) in synchronization with a clock signal (CLK). The $i^{th}$ bit (i=1 to N) comprises a selection circuit SEi, level shifter LSi, H (high) side pull-up switching element Nui, and L (low) side pull-down switching element Ndi, and bit outputs Do1 to DoN are obtained. The selection circuits SEi perform selection and switching of display mode operation and write mode operation, and execute control of delay time (dead time) such that the pull-up switching element Nui and pull-down switching element Ndi are not turned on simultaneously.

FIG. 8 shows the configuration of the output circuit for one bit in the above scan driver IC. IGBTs are preferably used for the pull-up switching element Nu and pull-down switching element Nd, but it will be appreciated by those skilled in the art that other types of devices may be used instead. Ci indicates the load capacitance.

In the shift registers SR1 to SRN, when data transferred to Si is at a high or H level, the pull-down switching element Ndi is turned on and the output Doi goes to a low or L level, and when the data transferred to SRi is at the L level, the pull-up switching element Nui is turned on and the output Doi is at the H level. Further, when in scanning mode as shown in FIG. 9, in the N-bit output Doi (i=1 to N), the L-level output is outputted in sequence. FIG. 9 is a timing chart showing operation of a scan driver IC of the prior art. When the output Doi is at the L level, the corresponding row of the PDP is selected.

However, in recent years there have been urgent demands to reduce the costs of the above scan driver ICs, accompanying falling prices for PDP televisions. Reduction of the chip size is an effective means of lowering the cost of scan driver ICs. Hence it has been proposed that the H-side pull-up switching elements Nu1 to NuN be replaced with resistance elements R1 to RN. FIG. 10 is a block diagram showing the configuration of another such scan driver IC of the prior art. Also, FIG. 11 shows the configuration of the output circuit for one bit in the scan driver IC of FIG. 10.

By replacing the pull-up switching elements Nui with resistance elements Ri, the H-side pull-up switching elements Nui are eliminated, and the level shifters LSi driving them also become unnecessary and can be omitted. In the case of a scan driver IC, the total area occupied by the level shifters LS1 to LSN, which convert logic signals at approximately 5 V to high-voltage signals at approximately 120 V, is approximately 15% of the total, and so elimination of these level shifters LS1 to LSN is effective for reducing costs.

In addition, in order to reduce the chip size of driving voltage supply circuitry for line-sequential driving with large currents in the above-described display driving device, without requiring special circuit elements or processes, it has been proposed that the resistance elements Ri of FIG. 11 be replaced with diodes Di, and that the cathodes of the diodes Di be connected to the pull-down switching elements Ndi, while also providing pull-up PMOS transistors connected in common to a plurality of diode anodes between this connection point and the driving voltage VDH (see for example Japanese Patent Laid-open No. 2005-129121).

SUMMARY OF THE INVENTION

However, in a display driving device of the prior art which displays a PDP as described above, if the H-side pull-up switching elements Nui are replaced with resistance elements Ri, the load capacitances Ci are charged through these resistance elements Ri at the time that the output rises (see the broken-line arrow in FIG. 11), and so as shown in FIG. 12, when the value of the resistance elements Ri is high, there is the problem that the rise time of the output (indicated as Do1 in FIG. 11) is long. FIG. 12 shows the output waveform of a scan driver IC of the prior art. In the figure, A is the output waveform of the circuit shown in FIG. 8, and B and C show output waveforms of the circuit shown in FIG. 11; B is for the case in which the value of the resistance elements Ri is 0.7 kΩ, and C is for a case in which the resistance elements Ri are of higher resistance than this.

In the case of a scan driver IC, rapid scanning operation is necessary due to the PDP specifications, and so the output rise time must be held to within approximately 300 ns. In the circuit of the prior art shown in FIG. 8, the L-side pull-down switching elements Ndi have a driving capacity enabling a fall time of approximately 50 ns, and the H-side pull-up switching elements Nui have a driving capacity enabling a rise time of approximately 150 ns. However, in the circuit of the prior art shown in FIG. 11, the value of the resistance elements Ri must be made approximately 0.7 kΩ in order to keep the rise time within approximately 300 ns, and in this case a large leakage current flows between VDH and GND when the output is at the L level. This leakage current may be as large as approximately 170 mA when VDH=120 V, posing a major problem in terms of PDP specifications, with respect to both current consumption and to heat dissipation arising from the leakage current.

Further, the device presented in Japanese Patent Laid-open No. 2005-129121, as described in paragraph [0052] thereof, is such that in one display operation period, both the transistors equivalent to the Nui and Ndi in FIG. 8 and FIG. 11 are turned off by the numerous output driving portions(a number equal to one less than ¼ the total number (equivalent to N above) of output driving portions), so that a state of high output impedance is entered. Further, it is explained therein that "the immediately preceding VH voltage is held". This means that VH is held by the parasitic capacitance associated with the output terminals, and is an inherently dangerous condition, susceptible to noise; the problem arises of coupling (crosstalk) occurring when an adjacent element is turned on and a large current flows, and so there are concerns of adverse effects on the PDP display quality.

Further, in paragraph [0071] thereof it is stated that "viewing simultaneous action . . . there is the problem of susceptibility to the effects of coupling", and so reduction of control systems is indicated; but even if the number of systems were increased, there is inherently no means of reducing the effect of coupling. In particular, with the trend toward larger PDP screen sizes, currents flowing in adjacent elements tend to become large, and so the influence of coupling can in no way be ignored.

This invention was devised in light of such problems, and has as an object the provision of a display driving device which is capable of high-speed scanning operation, the chip size of which can be made small, and costs for which can be lowered, and which in addition has no problems with coupling.

In order to resolve the above problems, a display driving device according to a preferred embodiment of this invention, which performs scan driving of a display panel, comprises a pull-up switching element, connected to a first driving voltage supply line, and common to all bits each of which is a unit circuit of the display driving device; diodes for each bit, connected between the pull-up switching element and driving voltage output terminals for each bit; pull-down switching elements for each bit, connected between a second driving voltage supply line and the driving voltage output terminals for each bit; and resistance elements for each bit, connected between the first driving voltage supply line and the pull-down switching elements.

A display driving device according to a preferred embodiment of this invention uses a pull-up switching element common to each bit, turns on for a short time the pull-up switching element when raising the output for each bit, and when the output has risen, maintains the H (high) level output using resistance elements, so that high-speed scan operation is possible, the chip size can be reduced, and lower costs can be achieved, and there is also the advantage that the problem of coupling is eliminated.

DETAILED DESCRIPTION OF THE INVENTION

Figure 1:
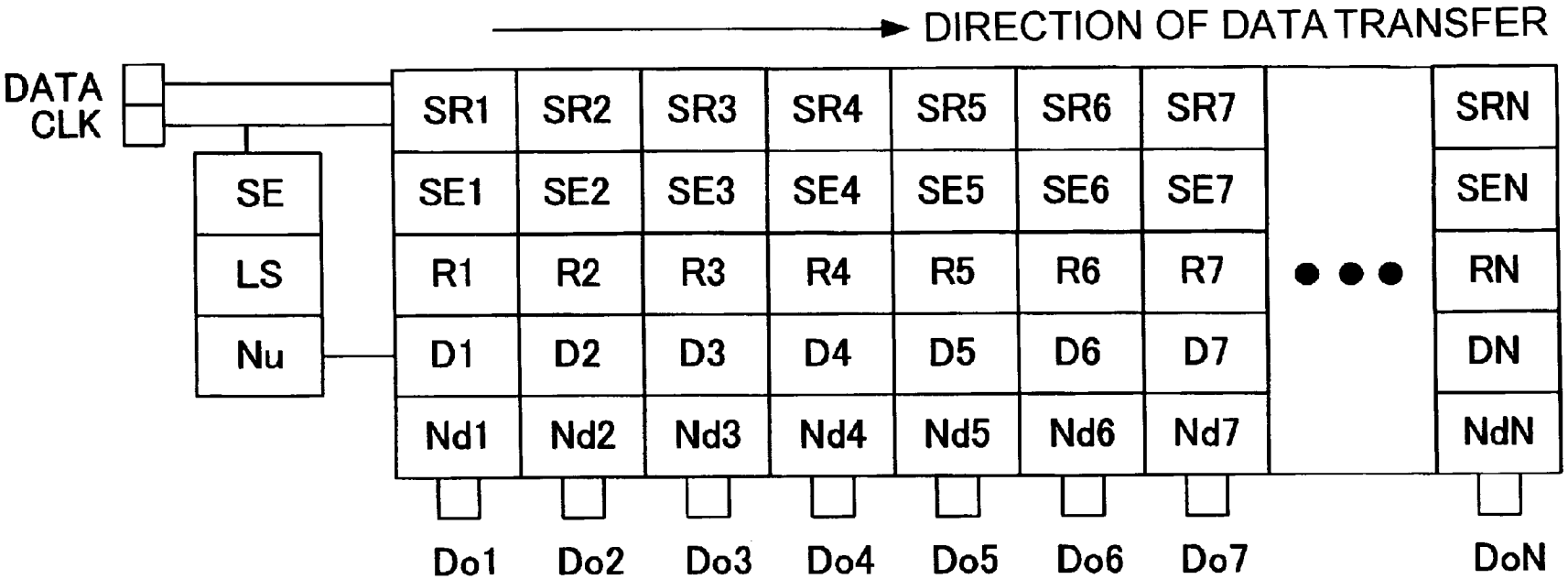
FIG. 1 is a block diagram showing the configuration of the scan driver IC of a first embodiment of the invention.

Below, embodiments of the invention are explained referring to the drawings.

FIG. 1 is a block diagram showing the configuration of the scan driver IC of a first embodiment of the invention. This scan driver IC, together with a data driver IC, not shown, form a display driving device that drives a PDP.

The above scan driver IC comprises numerous unit circuits (output circuits); these unit circuits, or their outputs, are called bits. Data input from a data terminal of the scan driver IC is transferred, in the direction of the arrow in the figure, to the shift registers SR1 to SRN in synchronization with a clock signal. The $i^{th}$ bit (i=1 to N) comprises a selection circuit SEi, resistance element Ri, diode Di, and L-side pull-down switching element Ndi; outputs Do1 to DoN are obtained for each bit. Further, an H-side pull-up switching element Nu, level shifter LS, and selection circuit SE, common to each bit, are also included therein. The selection circuits SE and SEi perform selection and switching of display mode operation and write mode operation, and execute control to turn on the pull-down switching elements Ni after the pull-up switching element Nu has been turned off, in order that the pull-up switching element Nu and pull-down switching elements Ndi are not on at the same time.

Figure 2:
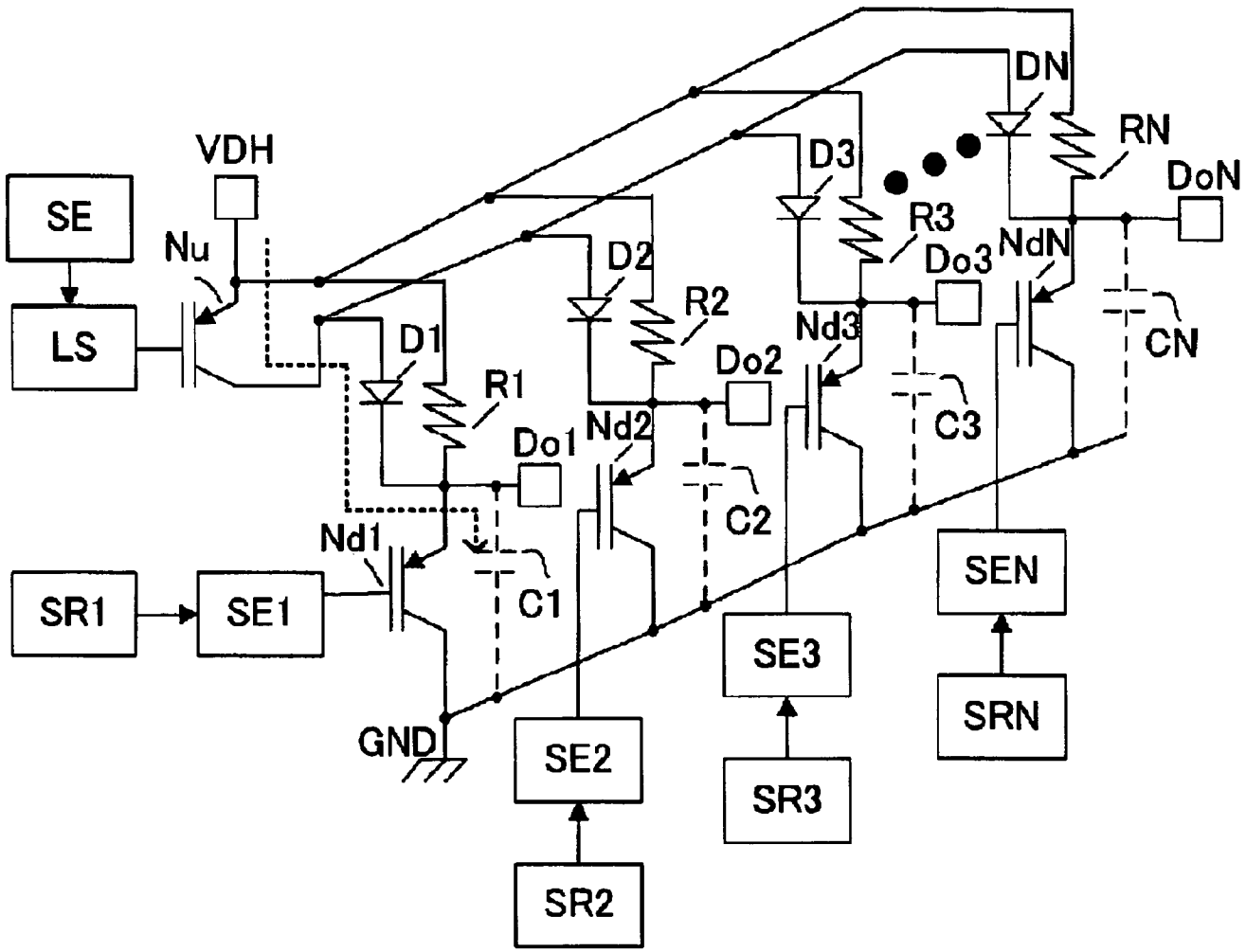
FIG. 2 shows the configuration of the output circuit of the scan driver IC of the first embodiment.

FIG. 2 shows the configuration of the output circuit in the scan driver IC of the first embodiment. The pull-up switching element Nu common to each bit is connected to a first driving voltage supply line connected to a first driving voltage VDH, and diodes D1 to DN for each bit are connected between this pull-up switching element Nu and the driving voltage output terminals of each bit. Further, the pull-down switching elements Nd1 to NdN for each bit are connected between a second driving voltage supply line, to which a second driving voltage GND is supplied, and the driving voltage output terminals of each bit; and resistance elements R1 to RN for each bit are connected between these pull-down switching elements for each bit Nd1 to NdN and the first driving voltage supply line.

IGBTs are preferably used for the above pull-up switching element Nu and pull-down switching elements Nd1 to NdN, but devices other than IGBTs may also be used without departing from the scope of the invention. C1 through CN indicate the load capacitances for each bit.

In the shift registers SR1 to SRN, when scan data transferred to SRi (i=1 to N) is at the H level, the pull-down switching element Ndi is turned on and the output Doi goes to the L level, and when the scan data transferred to SRi is at the L level, the pull-up switching element Nu is turned on and the output Do1 to DoN goes to the H level. Further, when in scan mode, at the outputs Doi of the N bits (i=1 to N), the L level is output sequentially (the on-off relationship may be the opposite between the scan data level and the pull-down switching elements Ndi and pull-up switching element Nu; conversely, in the shift registers SR1 to SRN, L level may be transferred sequentially as the scan data).

The pull-up switching element Nu operates in synchronization with the clock signals of shift registers SR1 to SRN which control the outputs Do1 to DoN of the driving voltage output terminals; the turn-on time is fixed at approximately 200 ns and is independent of the clock frequency. The pull-up switching element Nu and pull-down switching elements Ndi operate when there is scan data in SRi among the shift registers SR1 to SRN.

In the scan driver IC of the first embodiment, by turning on the common pull-up switching element Nu at the rising edge of the output of each bit, the output rise time can be shortened. Further, because the common pull-up switching element Nu is used for charging the load capacitances C1 to CN when outputs rise, the values of the resistance elements R1 to RN can be increased and current consumption can be suppressed. Moreover, because level shifters are not needed for each bit, the chip size can be reduced.

Figure 7:
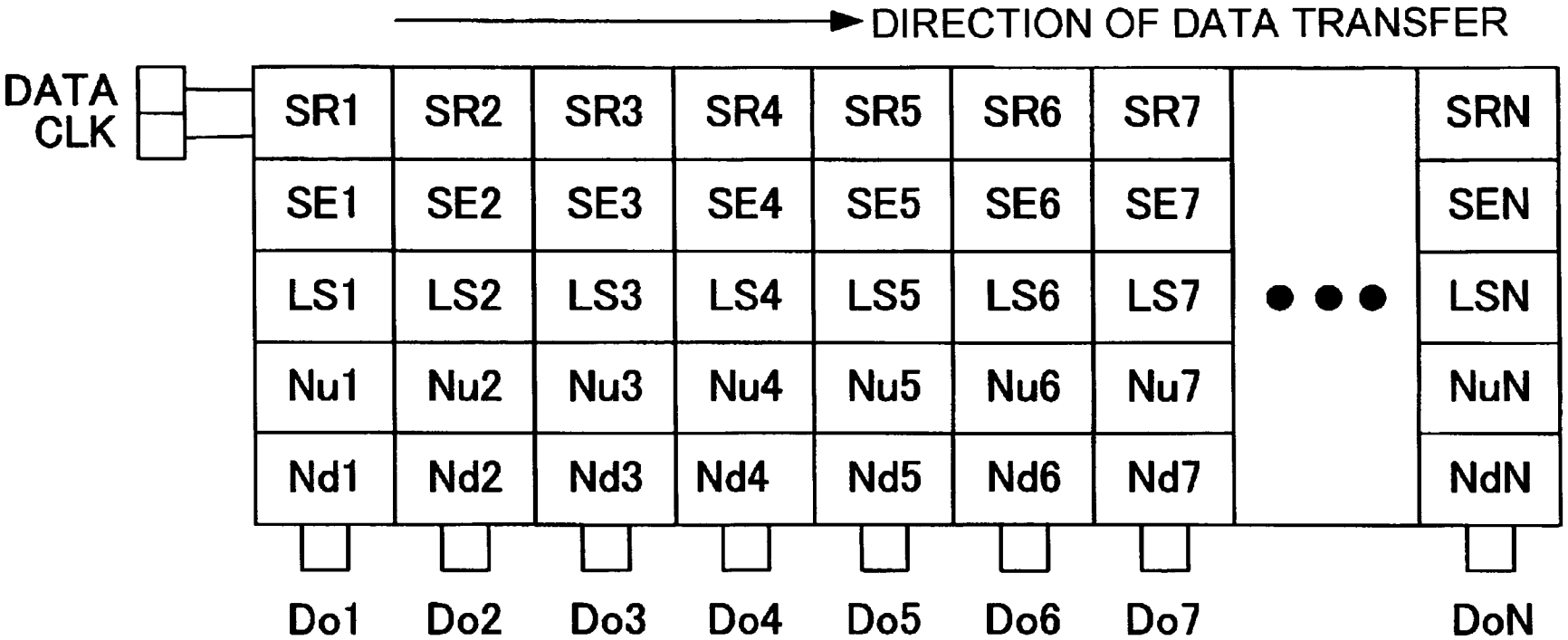
FIG. 7 PRIOR ART
FIG. 7 is a block diagram showing the configuration of a scan driver IC of the prior art.
Figure 10:
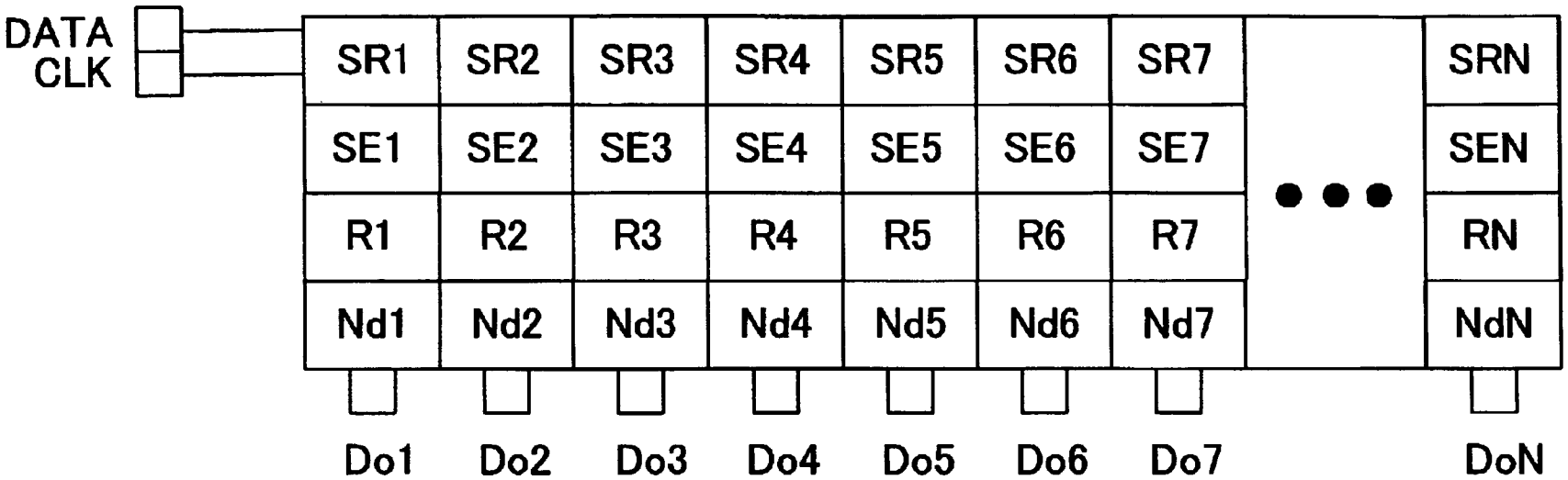
FIG. 10 PRIOR ART
FIG. 10 is a block diagram showing the configuration of another scan driver IC of the prior art.
Figure 11:
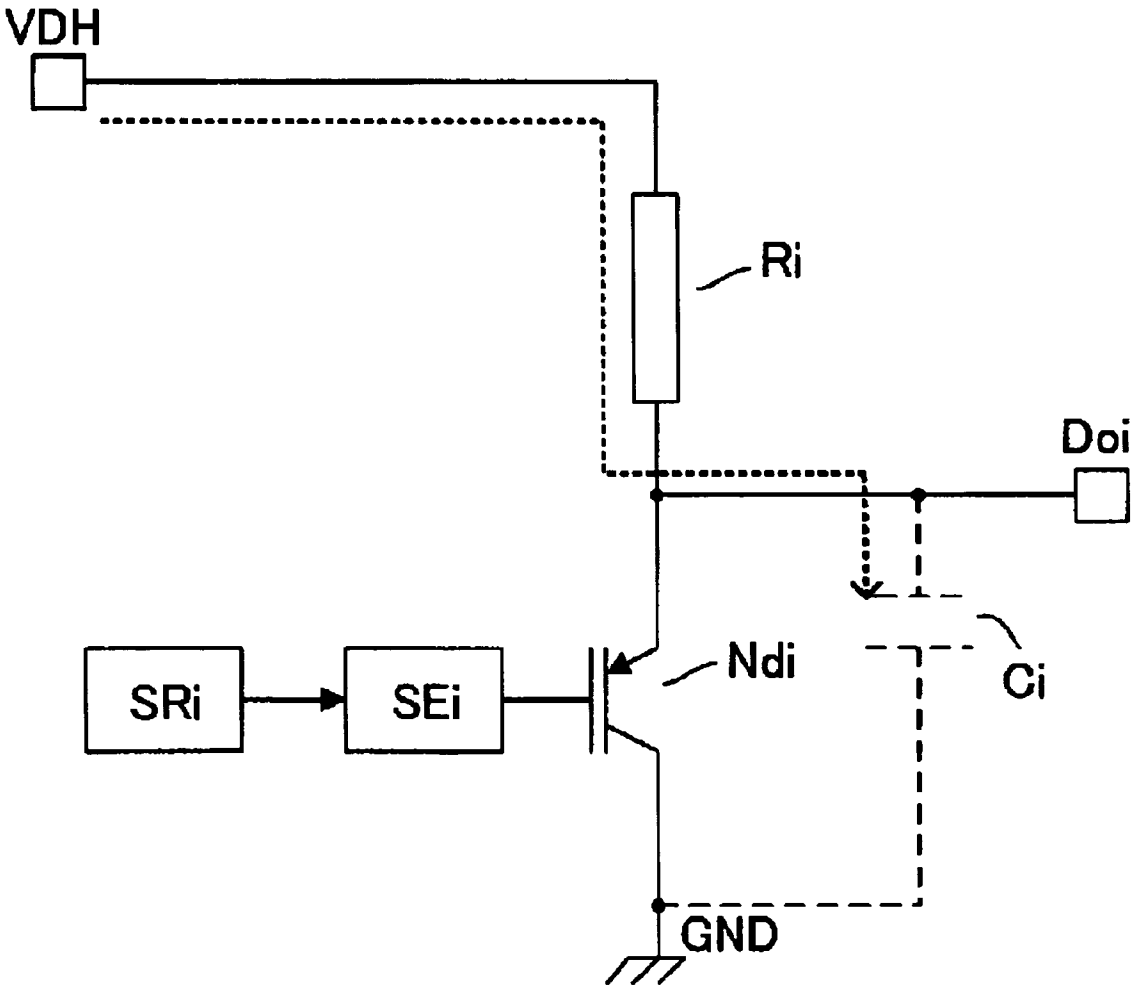
FIG. 11 PRIOR ART
FIG. 11 shows the configuration of the output circuit for one bit in the other scan driver IC of the prior art.
Figure 12:
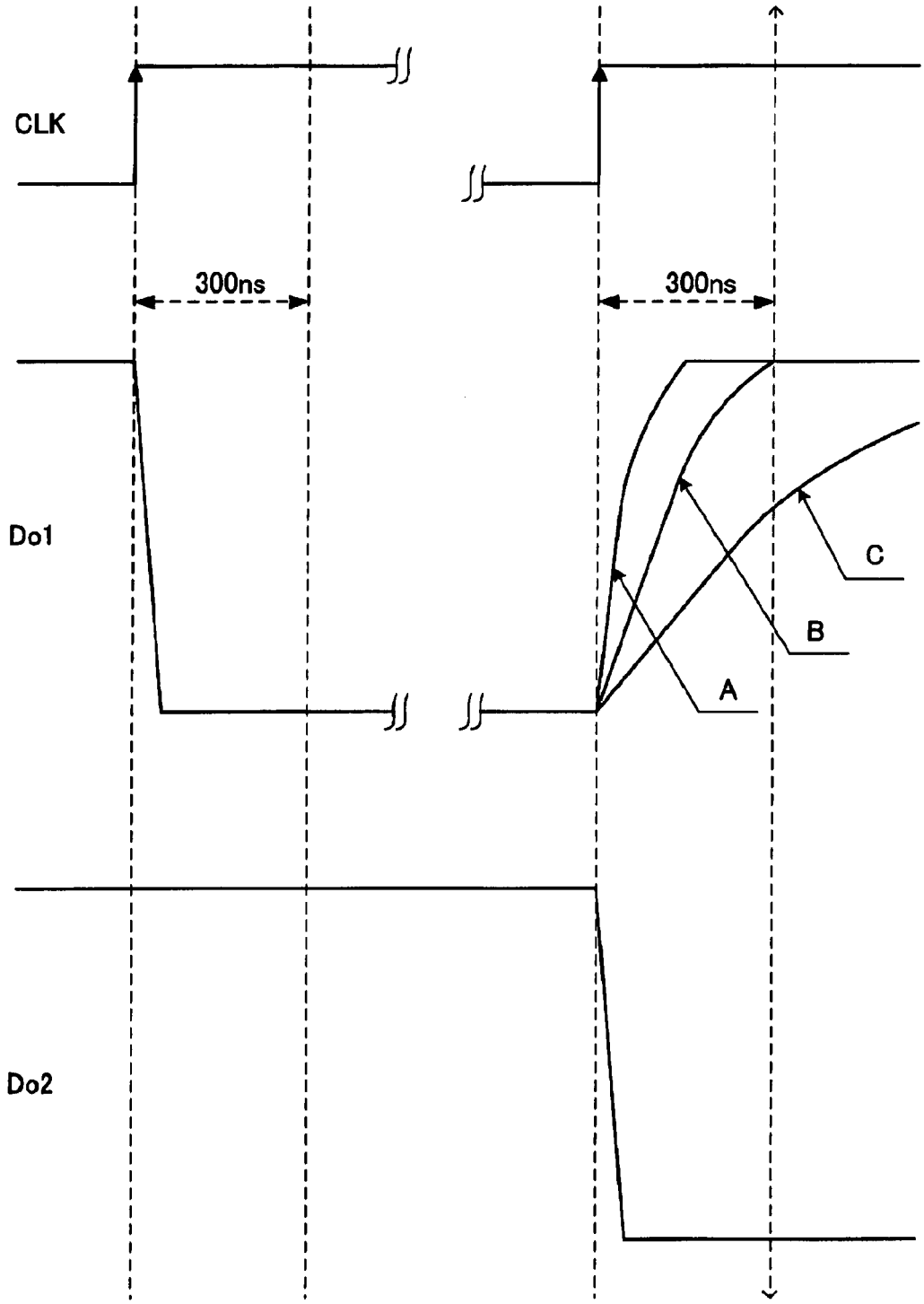
FIG. 12 PRIOR ART
FIG. 12 shows the output waveform in a scan driver IC of the prior art.

That is, in the first embodiment, a pull-up switching element Nu, level shifter LS, and selection circuit SE, common to all bits, are added to the prior art circuit shown in FIG. 10 and FIG. 11, and diodes D1 to DN are connected between the (emitter of the) pull-up switching element Nu and each of the driving voltage output terminals. The total area of the diodes D1 to DN is approximately 2% of the chip area of the integrated circuit of the prior art shown in FIG. 7, which is much smaller than the total area of the level shifters (LS1 to LSN in FIG. 7), and even when these are newly connected, the chip size can be made substantially smaller. Further, the placement positions of the common pull-up switching element Nu, level shifter LS and selection circuit SE are not greatly constrained, and can be positioned in the layout so as not to affect the chip size (or so as to minimize the effect).

Figure 3:
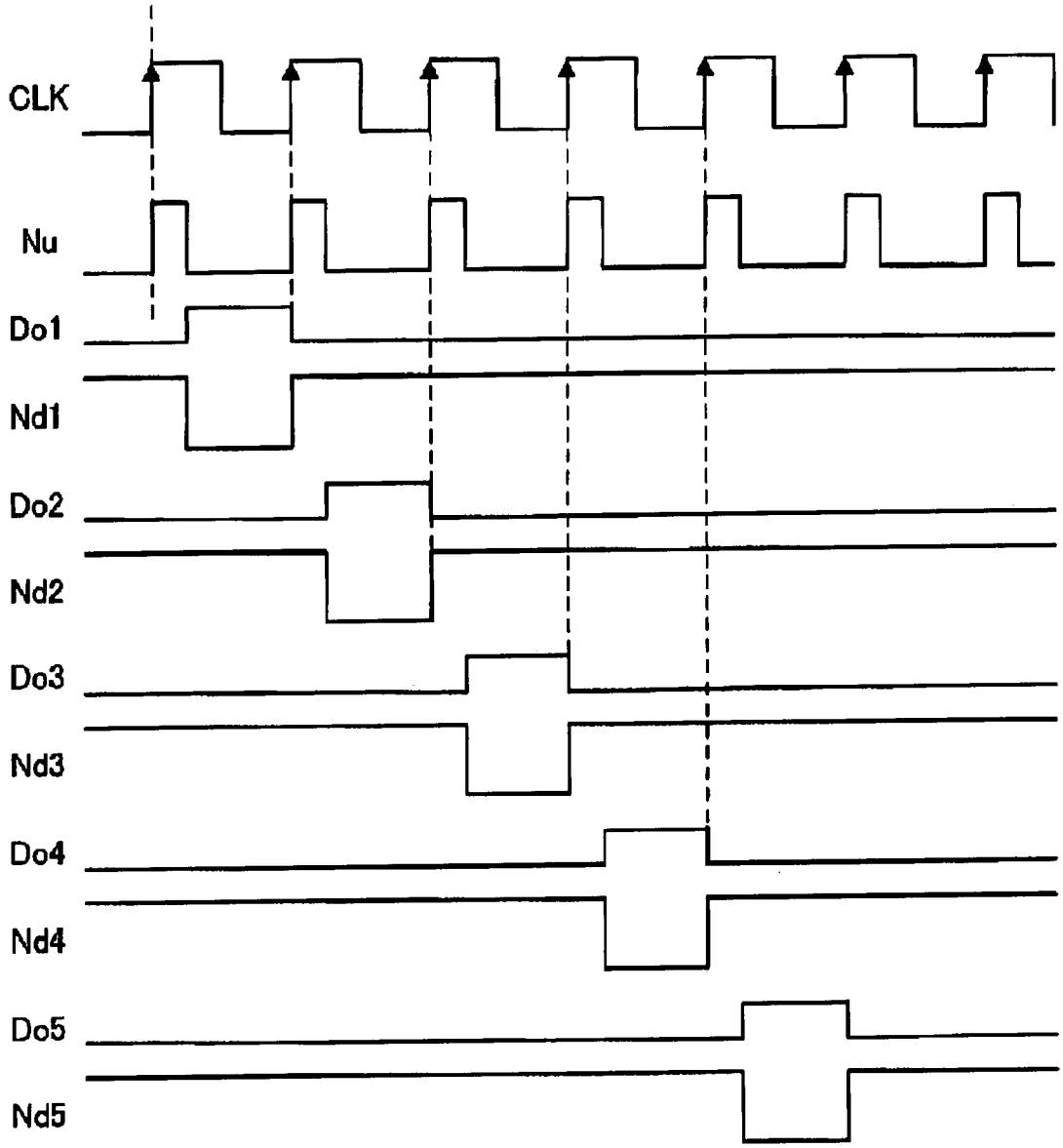
FIG. 3 is a timing chart showing operation of the scan driver IC of the first embodiment.
Figure 4:
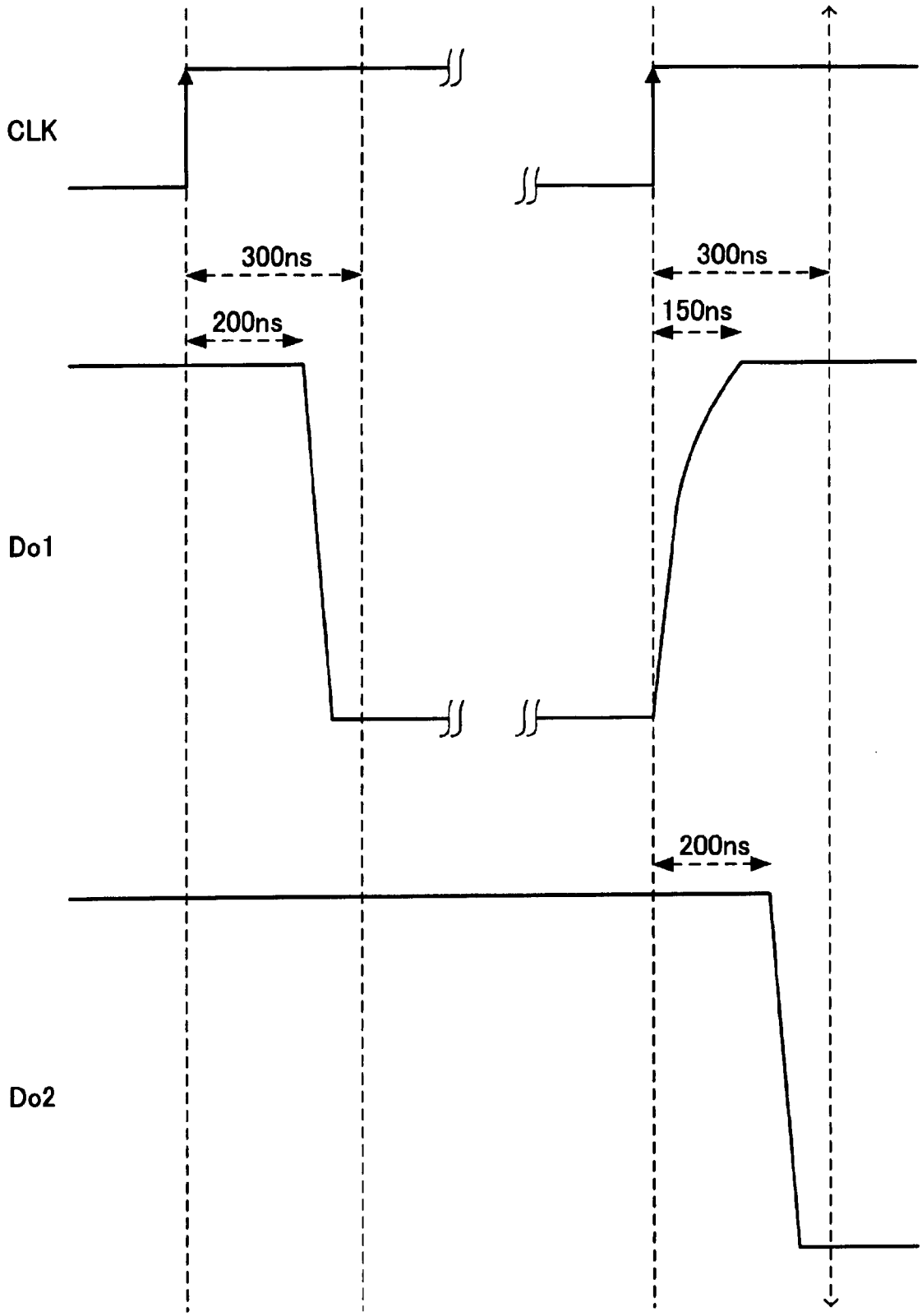
FIG. 4 shows the output waveform in the scan driver IC of the first embodiment.

FIG. 3 is a timing chart showing the operation of the scan driver IC of the first embodiment. When an output Doi (i=1 to N) is at the L level, the corresponding row of the PDP is selected. FIG. 4 shows an output waveform of the scan driver IC of the first embodiment.

The common pull-up switching element Nu is turned on for only a fixed interval of approximately 200 ns from the rising edge of the clock signal. During this interval, control is executed so that the pull-down switching elements Nd1 to NdN are turned off; this is because if there is an interval during which both are on, leakage current flows. In actuality, the pull-down switching elements Ndi are turned on simultaneously with the turning-off of the pull-up switching element Nu.

The pull-down switching elements Nd1 to NdN have the driving capacity to lower the outputs Do1 to DoN in approximately 50 ns, so that even when there is a delay of approximately 200 ns from the rising edge of the clock signal, the output can be lowered in a total of approximately 250 ns. This time is within 300 ns, and poses no problem. The common pull-up switching element Nu has a driving capacity to raise the output in 150 ns, and so a turn-on interval of 200 ns is sufficient.

Thus the scan driver IC of the first embodiment uses the pull-up switching element Nu in common for all bits, turns on for a short time (200 ns) the pull-up switching element when the output of the bits is raised, and maintains the H (high) level output by means of the resistance elements R1 to RN when the output rises, so that rapid scan operation is possible, the chip size can be reduced, costs can be reduced, and in addition there is the advantage that coupling problems are eliminated.

Figure 8:
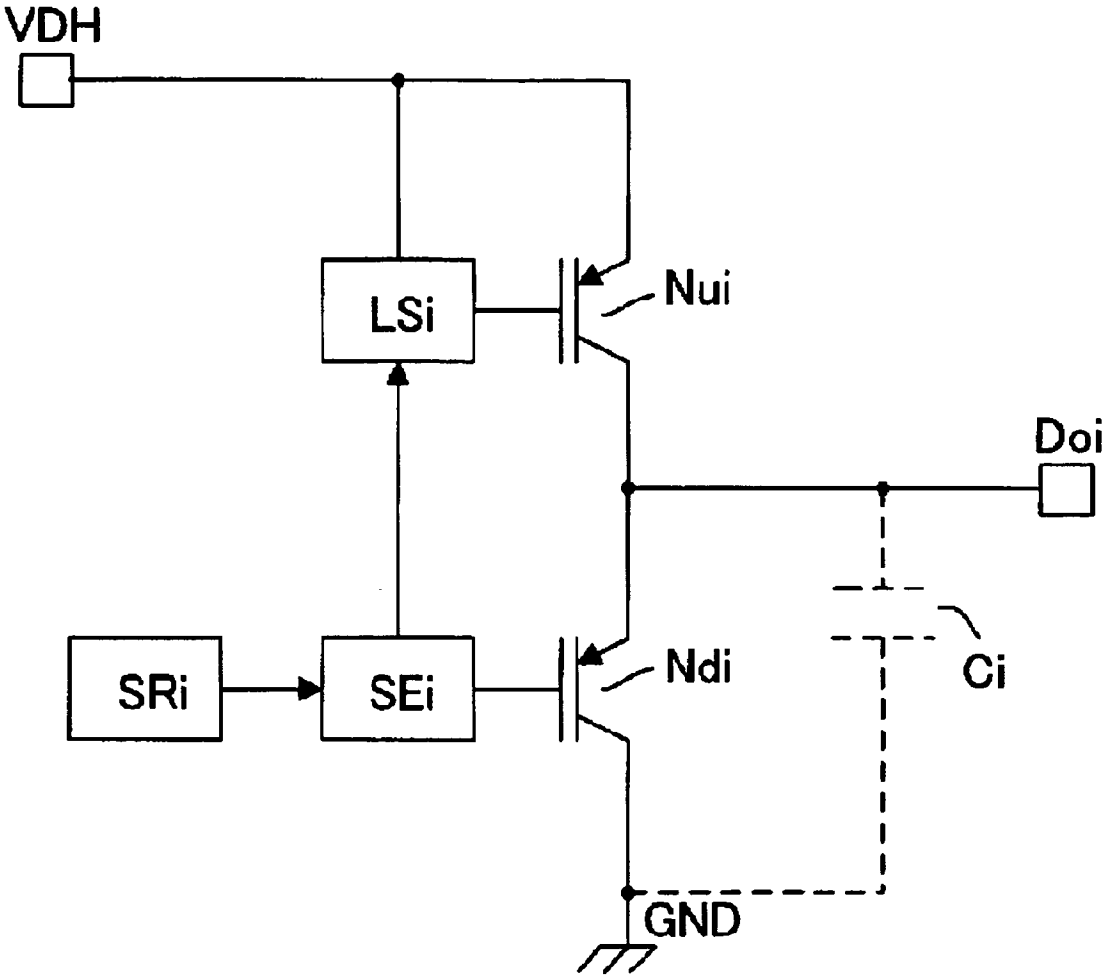
FIG. 8 PRIOR ART
FIG. 8 shows the configuration of the output circuit for one bit in a scan driver IC of the prior art.
Figure 9:
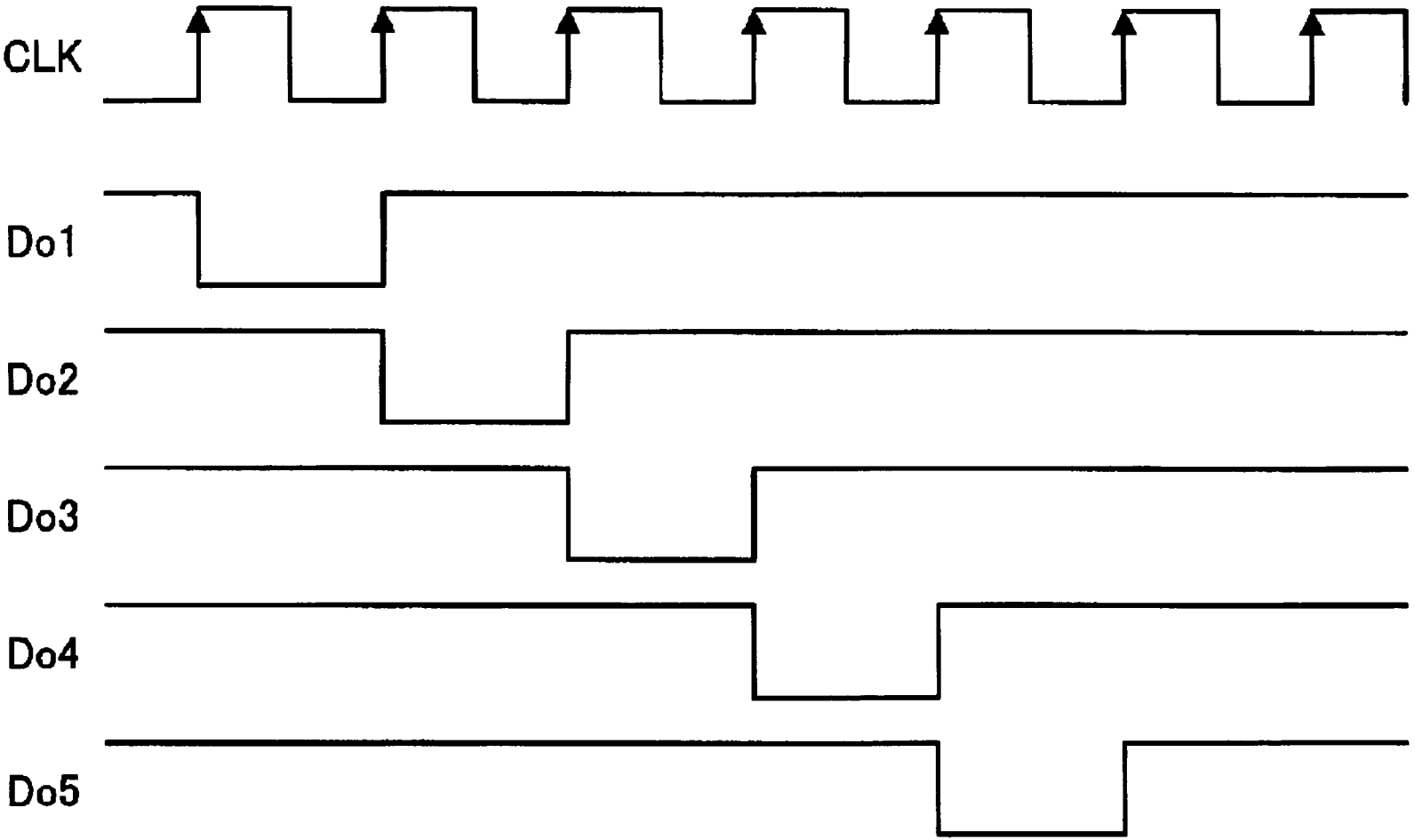
FIG. 9 PRIOR ART
FIG. 9 is a timing chart showing operation of a scan driver IC of the prior art.

Specifically, the chip area can be reduced by 13 to 15%, and significant cost reductions are possible. Further, by setting the values of the resistance elements R1 to RN to approximately 10 kΩ, current consumption can be reduced to 1/10 or less than that of the circuit shown in FIG. 10 and FIG. 11, and the current consumption can be made substantially equal to that of the circuit shown in FIG. 7 and FIG. 8.

Figure 5:
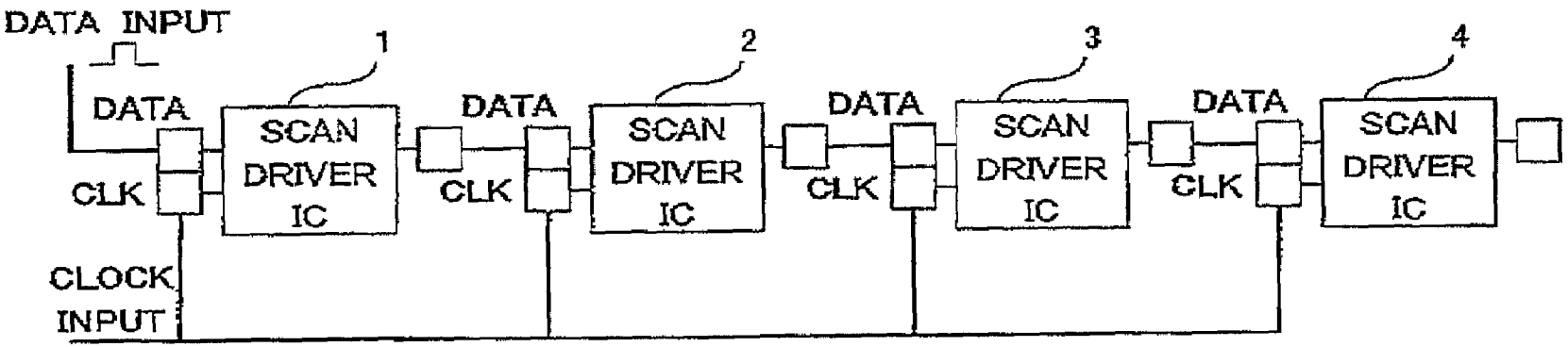
FIG. 5 is a block diagram showing the connection state of the scan driver IC in a PDP.

In an actual display panel, because of the large number of scan lines, scan driver ICs such as shown in FIG. 5 are used in a plurality of cascade connections. FIG. 5 is a block diagram showing the connections between scan driver ICs in a PDP. In the example shown, four 96-bit scan driver ICs 1 through 4 are connected together.

In the scan driver IC of the first embodiment, the common pull-up switching element Nu and level shifter LS always operate in synchronization with the rising edge of the clock signal. Further, in the scan operation of an actual display panel, among the plurality of scan driver ICs, only one scan driver IC is operating (is receiving scan data input), and so it is desirable that the common pull-up switching elements Nu and level shifters LS of the other scan driver ICs not be operating, in order to reduce current consumption of the entire system.

Figure 6:
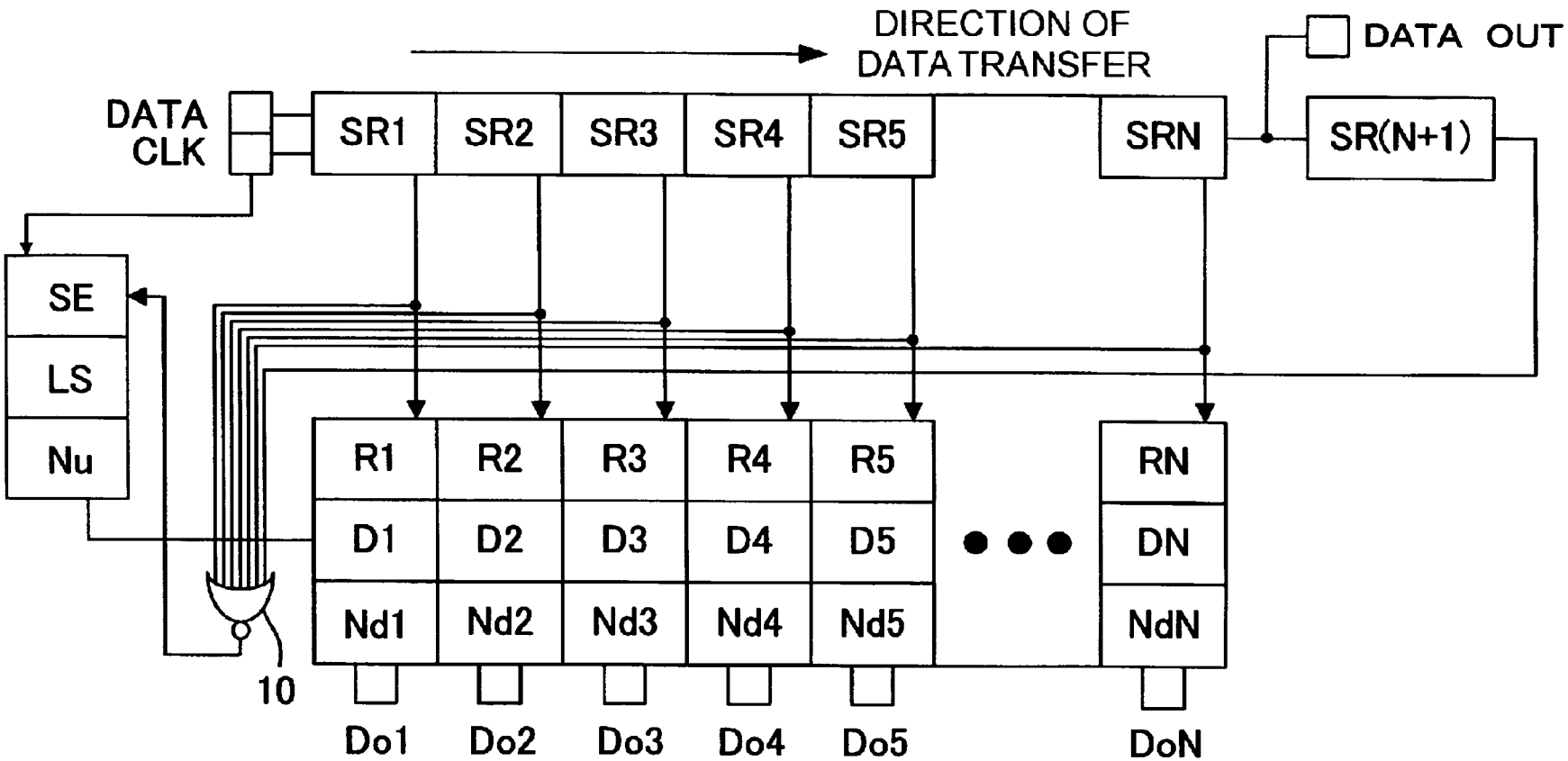
FIG. 6 is a block diagram showing the configuration of the scan driver IC of a second embodiment of the invention.

FIG. 6 is a block diagram showing the configuration of the scan driver IC of a second embodiment of the invention, configured such that the common pull-up switching elements Nu and level shifters LS are not operating during such intervals of non-operation (when scan data is not being input).

In the scan driver IC of the second embodiment, by inputting the outputs of the shift registers SR1 to SR(N+1) for each bit to a NOR circuit 10, the absence of scan data in the shift registers SR1 to SR(N+1) is detected. SR(N+1) is added in order to increase the number of shift register stages from N to (N+1), for the purpose of stabilizing operation at the instant when scan data is discharged from SRN. The output of SRN is connected to the input of SR1 of the next-stage scan driver IC. When there is no scan data, the selection circuit SE ensures that the common pull-up switching element Nu and level shifter LS do not operate. In this way, current consumption can be greatly reduced. If SR(N+1) is not present, because the common pull-up switching element Nu and level shifter LS are turned off at the instant when scan data is discharged from SRN, there is the problem of a delay in the rising-edge waveform output of the final bit (DoN) of each scan driver IC.

It will be appreciated by those skilled in the art that the invention may be practiced otherwise than as specifically described herein, without departing from the scope thereof.

What is claimed is:

1. A display driving device, which performs scan driving of a display panel, comprising:

a plurality of unit circuits of the display driving device, each unit circuit receiving a bit of a plurality of bits; and a common pull-up switching element for the plurality of bits, having a first terminal thereof connected to a first driving voltage supply line, and a second terminal thereof connected to said plurality of unit circuits, wherein each unit circuit comprises:

a diode for each said bit, having a anode thereof connected to the second terminal of the common pull-up switching element and an cathode thereof connected to a driving voltage output terminal of the corresponding said unit circuit;

a pull-down switching element for each said bit, having a first electrode thereof connected to a second driving voltage supply line and a second electrode thereof connected to the driving voltage output terminal of the corresponding said unit circuit; and a resistor for maintaining an output of said driving output voltage terminal at a high logic level for each said bit, having a first end thereof connected to the first terminal of the common pull-up switching element and a second end thereof connected to the second electrode of the corresponding pull-down switching element.

2. The display driving device according to claim 1, wherein for each said bit the pull-down switching element is turned on after the pull-up switching element is turned off.

3. The display driving device according to claim 1, wherein the pull-up switching element operates in synchronization with a clock signal of a shift register circuit that controls an output of each said driving voltage output terminal, wherein an ON time of the pull-up switching element is fixed.

4. The display driving device according to claim 3, wherein the shift register shifts one high level data item or low level data item sequentially, and wherein the pull-up switching element and the pull-down switching elements operate when there is the one high level data item or low level data item in a corresponding portion of the shift register circuit.

5. A method of scan driving of a display panel, comprising:

providing a plurality of unit circuits, each unit circuit receiving a bit of a plurality of bits;

providing a common pull-up switching element for the plurality of bits, having a first terminal thereof connected to a first driving voltage supply line, and a second terminal thereof connected to said plurality of unit circuits;

providing a pull-down switching element of the corresponding said unit circuit for each said bit, having a first electrode thereof connected to a second driving voltage supply line and a second electrode thereof connected to the driving voltage output terminal of the corresponding said unit circuit;

turning the common pull-up switching element on and then off for each said bit;

outputting a high logic level to the driving voltage output terminal through a diode of the corresponding said unit circuit when the common pull-up switching element is turned on, said diode having a anode thereof connected to the second terminal of the common pull-up switching element and a cathode thereof connected to a driving voltage output terminal of the corresponding said unit circuit;

maintaining an output of said driving voltage output terminal at the high logic level by using a resistor of the corresponding said unit circuit having a first end thereof connected to the first terminal of the common pull-up switching element and a second end thereof connected to the second electrode of the corresponding pull-down switching element; and turning the corresponding pull-down switching element of the corresponding said unit circuit on and then off for each said bit.

6. The method according to claim 5, wherein the step of turning the common pull-up switching element on is synchronized with a rising edge of a clock signal of a shift register circuit, the shift register circuit controlling an output of each said driving voltage output terminal, and wherein an ON time of said common pull-up switching element is fixed.

7. The method according to claim 5, wherein, for each said bit, the step of turning the corresponding pull-down switching element on takes place after the step of turning the common pull-up switching element off.

8. The method according to claim 7, comprising shifting one high level data item or low level data item sequentially, and operating the common pull-up switching element and the corresponding pull-down switching element when there is the one high level data item or low level data item in a corresponding portion of the shift register circuit.

* * * * *